United States Patent [19]

Wahlberg

[11] 4,000,950

[45] Jan. 4, 1977

[54] WRITING INSTRUMENT

[76] Inventor: Eric C. Wahlberg, 32 Eighth St., Stamford, Conn. 06905

[22] Filed: July 9, 1975

[21] Appl. No.: 594,297

Related U.S. Application Data

[63] Continuation of Ser. No. 457,411, April 3, 1974, abandoned.

[52] U.S. Cl. ..... 401/32

[51] Int. Cl.[2] ..... B43K 27/04

[58] Field of Search ..... 401/29–34, 401/112–114, 17, 198, 199

[56] References Cited

UNITED STATES PATENTS

| | | | |
|---|---|---|---|
| 297,041 | 4/1884 | Ward | 401/29 |
| 2,883,968 | 4/1959 | Vertiz | 401/112 X |
| 3,079,894 | 3/1963 | Johmann | 401/31 |
| 3,196,839 | 7/1965 | Bertoglio et al. | 401/112 X |
| 3,477,792 | 11/1969 | Shore | 401/198 X |

FOREIGN PATENTS OR APPLICATIONS

| | | | |
|---|---|---|---|
| 430,370 | 6/1935 | United Kingdom | 401/17 |

*Primary Examiner*—Lawrence Charles
*Attorney, Agent, or Firm*—Alfred E. Miller

[57] ABSTRACT

A writing instrument having a plurality of writing media assemblies separately positionable in writing position by a single independent actuator.

8 Claims, 14 Drawing Figures

WRITING INSTRUMENT

The present application is a continuation of applicant's co-pending U.S. patent application, Ser. No. 457,411, filed on Apr. 3, 1974 and now abandoned.

This invention relates to writing instruments having a plurality of replaceable writing media which can be independently placed in writing position by one actuator.

The various writing instruments on the market are limited to requiring an actuator for each writing medium which is to be placed in writing position and that one writing medium must be retracted from writing position before another can be positioned. Each requires that the others are not in writing position when it is to be placed in writing position.

The present invention to be hereinafter more fully described illustrates an embodiment of a plurality of writing media assemblies assembled together with an actuator which can be manipulated to place each writing medium in writing position irrespective of the position of the remaining media.

It is therefore an object of this invention to provide a writing instrument with the capability of positioning each of a plurality of writing media in writing position irrespective of the condition of the other writing media.

Other objects of the invention will become more fully apparent with reference to the following drawings and specifications which relate to an embodiment of the invention.

IN THE DRAWINGS

Figures 1, 2, 3, 4, 5, 6, 7, 8, 9, 10, 11, 12, 13, 14:
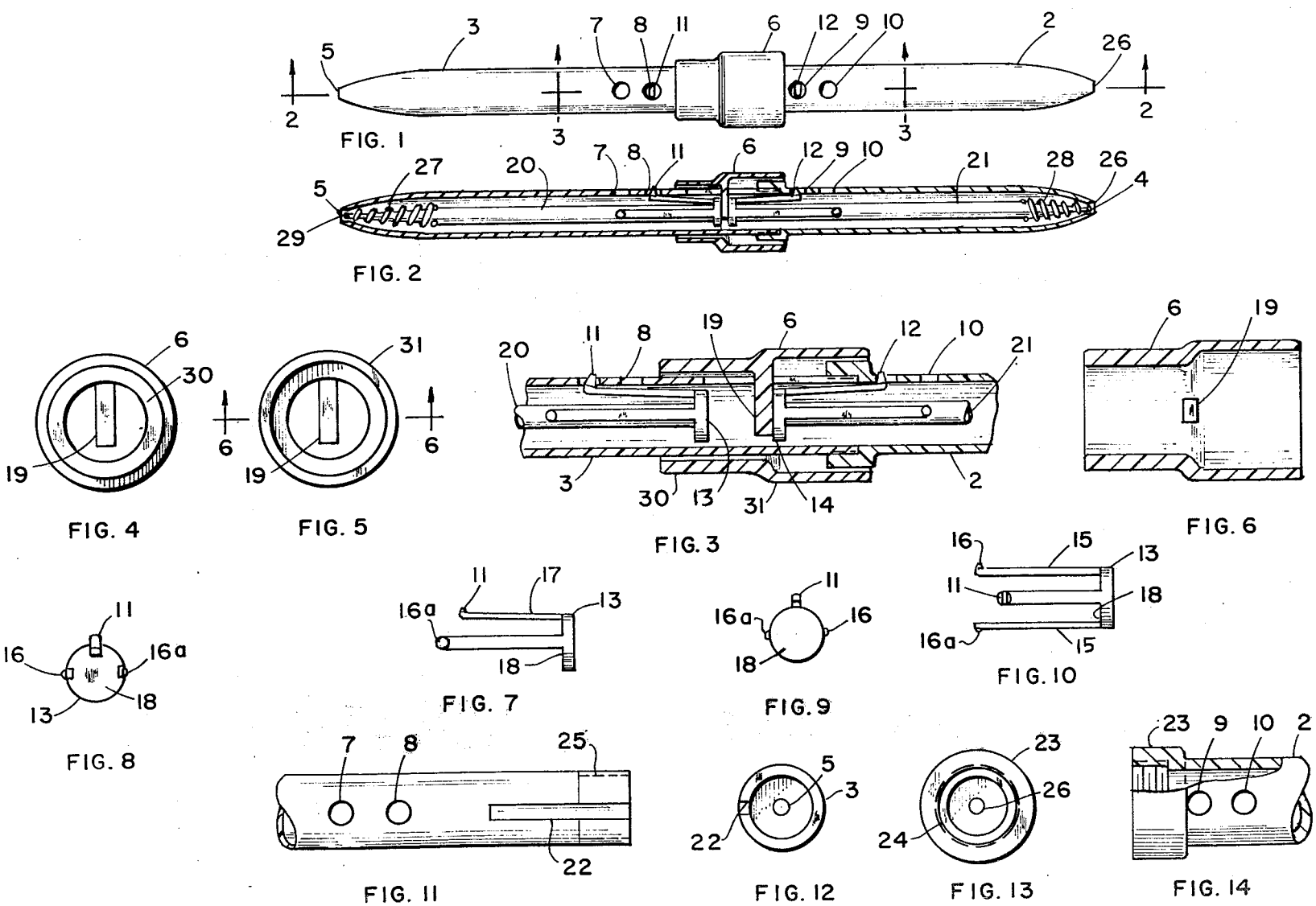
FIG. 1 is a view of the embodiment of the writing instrument.
FIG. 2 is a cross-section of the instrument taken along line 2—2 of FIG. 1.
FIG. 3 is an enlarged partial view taken along line 3—3 of FIG. 1.
FIG. 4 is an end view looking at the smaller end of the actuator 6.
FIG. 5 is a view of the larger diameter end of the actuator 6.
FIG. 6 is a cross-section of the actuator taken along line 6—6 of FIG. 5.
FIG. 7 is a view of the position 13 shown in FIG. 3.
FIG. 8 is an end view of FIG. 7.
FIG. 9 is an end view of FIG. 7 opposite to that of FIG. 8.
FIG. 10 is a view of FIG. 7 rotated 90°.
FIG. 11 is a fragmented view of the open end of the body 3 in FIG. 1.
FIG. 12 is an open end view of the body of FIG. 11.
FIG. 13 is an open end view of the body 2 of FIG. 1.
FIG. 14 is a fragmented view of the open end of body 2 in FIG. 1.

Referring to FIG. 1, there is shown a multiple writing media writing instrument with a first barrel 3, a second barrel 2 and an actuator 6. The first barrel 3 has openings 7 and 8 for positioning the first writing medium 20 (FIG. 2) in writing position or non-writing position respectively. Similarly, the second barrel 2 has openings 9 and 10 for keeping the second writing medium in non-writing and writing position respectively. An aperture 5 in the first barrel is provided for the extension of the first writing medium out of the barrel. An aperture 26 is provided for the extension of the second writing medium 4 out of the barrel.

Referring to FIG. 2, writing medium 20 includes a bias spring 27, a writing point 29 and a connecting writing fluid reservoir. The spring biases the writing medium inwardly from the aperture 5. A writing medium positioner 18 (FIG. 3, 8–10) has a guide disc 13 cooperating with the end of the writing medium 20. The guide disc 13 has two guides 15 extending longitudinally away from the disc 13. Each of the two guides has a dimple 16, 16*a* at its extreme end to reduce the friction on the internal surface of the barrel 3 when changing position of the writing medium. A positioning arm 17 (FIG. 7) also extends longitudinally from the guide disc 13. The positioning arm 17 has a positioning projection 11 at its extreme end. The positioning projection 11 is positioned in opening 8 (FIG. 2) by spring bias built into positioning arm 17.

The second writing medium 21 and the second writing medium positioner 14 are similarly constructed to that of the respective first units. However, the second barrel, while similarly constructed, has a few differences. The first barrel has a slot 22 FIG. 11 and an external thread 25. The second barrel has an expanded portion 23 (FIG. 14) which has an internal thread capable of being mated to thread 25 of the first barrel. It is not necessary that the coupling be by threaded means. Other coupling means may be used such as twist on, push on, etc.

A tabular actuator 6 (FIGS. 3–6) has an expanded portion 31 which fits over the expanded portion 23 of the second barrel 2. The unexpanded tubular portion 30 fits over the first barrel 3. Internally, of the tubular actuator 6 there is an actuator prong 19 extending inwardly and located substantially near the beginning of the expanded portion 31. The actuator 19 is longitudinally moveable in the slot 22 of the first barrel 3 and is limited in its longitudinal motion only by the length of the slot 22 and the coupling of barrel 2 to barrel 3 which produces the captivation of the actuator 6. The position of the slot 22 is shown in FIG. 11 as being in line with positioning openings 7 and 8. The position of the slot 22, however, may be in any angular position relative to the openings 7 and 8 and, in fact, to openings 9 and 10.

In assembly of the multi-writing medium instrument, the writing medium 20 and spring 27 is inserted into the barrel 3. Writing medium positioner 18 is inserted with the guide arms 15 and positioning arm 17 entering the barrel before the guide disc 13. The actuator 6 is positioned behind the positioner guide disc 13 with actuator prong 19 in the slot 22 of barrel 3. The second writing medium 21 together with its bias spring 28 is inserted in barrel 2. Positioning guide disc 14 (FIG. 3) is inserted with the guide arms entering the barrel before positioning guide disc enters. The second barrel 2 is now coupled to the first barrel 3 by means of threads 25. This locks the actuator into the slot 22 with motion limited to capability of pushing positioning 17 to opening 7 in barrel 3 or positioning arm of 14 to opening 10 in barrel 2.

Pushing the actuator 6 in the direction of the first barrel 3 positions positioning arm 11 in opening 7. This compresses spring 27 which results in the writing medium point 29 being extended out of aperture 5 into writing position. Separately, pushing actuator 6 in the direction of the second barrel 2 positions positioning arm 12 in the opening 10. This compresses spring 28 which results in the writing medium point 4 being extended into writing position through aperture 26. By pushing positioning projection 11 into the barrel 3, the spring 27 is allowed to force writing medium 20 and positioning unit 18 into a non-writing position whereby positioning projection 11 enters opening 8. This is accomplished without disturbing the second writing medium 21. Similarly, the second writing medium 21 may be positioned in non-writing position by pushing position projection 12 into barrel 2 to allow the force of spring 28 to push writing medium 21 and writing medium positioner 14 into the barrel 2 until positioning projection 12 enters hole 9. This is also accomplished without disturbing the position of the first writing medium 20. Thus there is a writing medium in each end of the writing instrument each individually and separately extendable out of its corresponding aperture into writing position by operating the one actuator 6.

To replace the writing medium the two barrels are uncoupled from each other. The writing media are replaced by first removing the contents of each barrel and replacing the writing media. The assembly of the writing instrument is then done by following the method of assembly hereinbefore described.

It is now evident that there has been provided a multi-writing medium writing instrument having a plurality of replaceable writing media which are independently actuated into writing or non-writing position in the writing instrument and that the writing media need not necessarily be of the same type in the same instrument.

What is claimed is:

1. A multi-writing means writing instrument comprising a hollow body having a plurality of writing means therein, a separate positioning means located entirely within said hollow body co-acting with each of said plurality of writing means to hold said writing means in either writing or non-writing position in said writing instrument, a separate positioner actuator means located externally on said hollow body and having a part projecting into the interior of said hollow body, said projecting part being freely movable and physically unconnected to each of said positioning means and co-acting separately with each of said positioning means to individually move each of said positioning means into a position where said writing means is held in writing position in said writing instrument separately and independently from the other of said positioning means, and both of said writng means being capable of being positioned at the same time in writing positions at opposite ends of said writing instrument.

2. The writing instrument as recited in claim 1, wherein said writing means includes a ball point pen.

3. The writing instrument as recited in claim 1, wherein said writing means includes replaceable writing means.

4. The writing instrument as recited in claim 1, wherein said writing means includes a felt tip pen.

5. The writing instrument as recited in claim 1, wherein said hollow body includes two barrels positioned end to end, each of said barrels having a coupling means at one end and an aperture in the non-coupling end.

6. The writing instrument as recited in claim 1, and further comprising a longitudinal slot in said body and, wherein said positioner actuator means includes a tubular operator surrounding an extension part of said body and is provided with an actuator member extending inwardly through said slot in said body to cooperate with said positioning means.

7. The writing instrument as recited in claim 5, wherein said coupling means includes screw threads.

8. A multi-writing means writing instrument as recited in claim 1, wherein said body includes at least two ends, each barrel having a coupling means in one end for attaching together said at least two barrels, and at least one aperture in each of the other ends of said barrels.

* * * * *